US009453400B2

(12) United States Patent
Wheeler et al.

(10) Patent No.: US 9,453,400 B2
(45) Date of Patent: Sep. 27, 2016

(54) ENHANCED RECOVERY AND IN SITU UPGRADING USING RF

(75) Inventors: Thomas James Wheeler, Houston, TX (US); Wayne Reid Dreher, College Station, TX (US); Francis Eugene Parsche, Palm Bay, FL (US); Mark Alan Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 646 days.

(21) Appl. No.: 13/232,607

(22) Filed: Sep. 14, 2011

(65) Prior Publication Data

US 2012/0234536 A1 Sep. 20, 2012

Related U.S. Application Data

(60) Provisional application No. 61/382,696, filed on Sep. 14, 2010, provisional application No. 61/466,349, filed on Mar. 22, 2011.

(51) Int. Cl.
*E21B 43/24* (2006.01)

(52) U.S. Cl.
CPC ..... *E21B 43/24* (2013.01); *E21B 43/2401* (2013.01)

(58) Field of Classification Search
CPC ..... E21B 43/24; E21B 43/2401; E21B 43/2408; C08F 8/44
See application file for complete search history.

(56) References Cited

U.S. PATENT DOCUMENTS

| | | | | |
|---|---|---|---|---|
| 4,144,935 | A | 3/1979 | Bridges | |
| 4,401,162 | A * | 8/1983 | Osborne | 166/248 |
| 4,638,862 | A * | 1/1987 | Savage | 166/248 |
| 4,706,751 | A * | 11/1987 | Gondouin | 166/401 |
| 5,055,180 | A | 10/1991 | Klaila | |
| 6,499,536 | B1 * | 12/2002 | Ellingsen | 166/248 |
| 8,365,823 | B2 * | 2/2013 | Dreher et al. | 166/272.1 |
| 8,464,789 | B2 * | 6/2013 | Banerjee et al. | 166/248 |
| 2005/0239661 | A1 * | 10/2005 | Pfefferle | 507/100 |
| 2006/0102625 | A1 | 5/2006 | Kinzer | |
| 2007/0187089 | A1 * | 8/2007 | Bridges | 166/248 |
| 2008/0125559 | A1 * | 5/2008 | Radosz et al. | 526/239 |
| 2008/0190813 | A1 * | 8/2008 | Dana et al. | 208/187 |
| 2008/0217008 | A1 * | 9/2008 | Langdon et al. | 166/270 |
| 2010/0078163 | A1 | 4/2010 | Banerjee et al. | |
| 2010/0218940 | A1 | 9/2010 | Parsche | |

(Continued)

FOREIGN PATENT DOCUMENTS

WO PCT/US11/51567 9/2011

OTHER PUBLICATIONS

Zou et al., Catalytic Degradation of Macromolecular Constituents of Asphaltic Sands in Ionic Liquids, Article Abstract [online], Dec. 2004 http://en.cnki.com.cn/Article en/CJFDTOTAL-HGSZ200412029.htm> the Abstract.

(Continued)

*Primary Examiner* — Angela M DiTrani
*Assistant Examiner* — Andrew H Sue-Ako
(74) *Attorney, Agent, or Firm* — Boulware & Valoir

(57) ABSTRACT

A method for heating heavy oil inside a production well. The method raises the subsurface temperature of heavy oil by utilizing an activator that has been injected below the surface. The activator is then excited with a generated non-microwave frequency from 0.1 MHz to 300 MHz such that the excited activator heats the heavy oil.

16 Claims, 3 Drawing Sheets

(56) References Cited

U.S. PATENT DOCUMENTS

| | | | |
|---|---|---|---|
| 2010/0219107 | A1 | 9/2010 | Parsche |
| 2010/0294488 | A1 | 11/2010 | Wheeler et al. |
| 2010/0294489 | A1 | 11/2010 | Wheeler et al. |

OTHER PUBLICATIONS

Absorption of EM radiation, Lecture [online], Apr. 14, 2010 [retrieved on Feb. 7, 2012)). Retrieved from the Internet:<URL: http://www.geo.mtu.edu/-scarn/teaching/GE4250/absorption_lecture.pdf>p. 7.

* cited by examiner

ENHANCED RECOVERY AND IN SITU UPGRADING USING RF

CROSS-REFERENCE TO RELATED APPLICATIONS

This application claims priority to U.S. Provisional No. 61/382,696 filed Sep. 14, 2010, and U.S. Provisional No. 61/466,349 Mar. 22, 2011, and incorporated herein in their entireties.

STATEMENT REGARDING FEDERALLY SPONSORED RESEARCH

None

FIELD OF THE INVENTION

The invention relates to enhanced oil recovery using an activator and lower frequency radio waves in conjunction with other thermal mobilization methods to improve oil recovery and increase cost effectiveness, wherein the activator absorbs RF waves, thus imparting heat to the formation. Also, in-situ upgrading of heavy crude oil using a lower frequency radio frequency together with a catalyst.

BACKGROUND OF THE INVENTION

The production of heavy oil and bitumen from a subsurface reservoir is quite challenging. One of the main reasons is that the viscosity of the oil is often greater than one million centipoise. Therefore, the removal of the oil from the subsurface is typically achieved by either surface mining or by the introduction of heat into the reservoir to lower the viscosity of the oil and thus allow it to be produced by the usual drilling and pumping techniques.

Thermal recovery has long been established as allowing the recovery of heavy oil and bitumen resources. It is well known the viscosity of oil is reduced when the oil is heated, and the viscosity of heavy oils can be reduced from millions of centipoise to 1-10 centipoise by injecting steam into the hydrocarbon reservoir. Cyclic steam stimulation ("CSS") operations have been employed in heavy oil reservoirs around the world recovering millions of barrels of oil. Due to the extremely high viscosities of bitumen, cyclic steam operations have not been employed on a commercial scale due to the difficulty in initiating the recovery process and establishing commercial sustainable rates.

The steam assisted gravity drainage ("SAGD") is an improved steam process that utilizes two horizontal wells vertically separated by approximately 5 meters. The process is initiated by circulating steam in both the wells to heat the heavy oil/bitumen between the well pairs via conduction until mobility is established, and gravity drainage can be initiated. Then the oil drains to the lower well, and is collected.

SAGD is one of the few commercial processes that will allow for the in-situ recovery of bitumen reserves. Due to the fact that the process requires steam and water treatment, a large capital investment in surface facilities is required, and a high operating expenditure or "OPEX" results. In addition, the product, heavy oil or bitumen, is sold at a significant discount to West Texas Intermediate ("WTI", also known as Texas light sweet, a grade of crude oil used as a benchmark in oil pricing), providing a challenging economic environment when companies decide to invest in these operations.

These conditions limit the resource that can be economically developed to reservoir thicknesses, typically thicker than 15-20 meters.

The primary driver for high costs is the steam to oil ratio, that is, the amount of steam that is required to produce 1 $m^3$ or 1 barrel of heavy oil (bbl, 42 US gallons). During the recovery process, a well pair should be drilled and spaced such that it has access to sufficient resources to pay out the capital and operating costs. During the SAGD process, heat is transferred to the bitumen/heavy oil, as well as the overburden and underburden. In thinner reservoirs, economics do not allow wells to access sufficient resource, primarily due to high cumulative steam oil ratio "CSOR." As a rule of thumb, a SOR of 3.0 is the typical economic limit used in the SAGD recovery today.

Solvent can improve SAGD operations by accelerating production and reducing SOR. When solvent is co-injected with steam in SAGD, different operators call the process by different names, but it most commonly known as Solvent-Aided Process (SAP), Expanded Solvent-SAGD (ES-SAGD), solvent assisted gravity drainage, etc. ES-SAGD improves the SAGD process by adding a second mechanism, the solvent dissolution into the bitumen, to the reduction of the viscosity of the bitumen. For example, the viscosity of the bitumen at 115° C. is 100 cp. By adding a little solvent to the system, the viscosity of the crude can be reduced to 5 cp.

Both SAGD and ES-SAGD are technologies that have shown success in the field. However, both exhibit opportunities for further optimization of operations and increase of economic value. One approach that may be used to do this is the incorporation of RF into these operations. This can be achieved by utilizing a subsurface antenna that is installed with existing wells or wells or one that is installed as a stand alone antenna.

Radio frequencies (RF) have been used in various industries for a number of years. One common use of this type of energy is the household cooking appliance known as the microwave (MW) oven.

Microwave radiation couples with, or is absorbed by, non-symmetrical molecules or those that possess a dipole moment, such as water. In cooking applications, the microwaves are absorbed by water present in food. Once this occurs, the water molecules rotate and generate heat. The remainder of the food is then heated through a conductive heating process.

Hydrocarbons do not typically couple well with microwave radiation. This is due to the fact that these molecules do not possess a dipole moment. However, heavy crude oils are known to possess asphaltenes, which are molecules with a range of chemical compositions. Asphaltenes are often characterized as polar, metal containing molecules. These traits make them exceptional candidates for coupling with radio frequencies. By targeting these molecules with RF radiation, localized heat will be generated which will induce a viscosity reduction in the heavy oil.

Through the conductive heating of the heavy crude oil or bitumen in place, a potential decrease in the startup time of a steam assisted gravity drainage (SAGD) operation or expanding solvent steam assisted gravity drainage (ES-SAGD) operation may be experienced. This may also lead to decreases in the amount of water required to produce the heavy oil, as well as a potential reduction green house gas emissions produced, both of which will have positive economic and environmental impacts on operations.

Additionally, the use of RF radiation in the presence of an alternate heat source can decrease the activation energy required for converting and breaking down carbon-carbon bonds. This synergistic effect can lead to the in situ upgrading of heavy crude oils by breaking down molecules that are known to significantly increase the viscosity of the crude oil. However, the use of RF frequencies in a reservoir is not straight forward, nor is the selection of the appropriate RF frequency easily accomplished.

U.S. Pat. No. 4,144,935 attempts to solve this problem by limiting the range in which radio frequencies are used to heat a particular volume in a formation. Such a method decreases the ability for one to use radio frequencies over a broad area and does not eliminate the problem of selecting the appropriate radio frequency to match the multitude of chemical components within the crude oil or bitumen. Furthermore, this method does not teach directing a radio frequency into a production well or bitumen formation to upgrade the heavy oil prior to the refinery process.

U.S. Pat. No. 5,055,180 attempts to solve the problem of heating mass amounts of hydrocarbons by generating radio frequencies at differing frequency ranges. However use of varying radio frequencies means that there are radio frequencies generated that are not efficiently utilized. In such a method one would inherently generate radio frequencies that have no effect on the heavy oil or bitumen. Furthermore, this method does not teach directing a radio frequency into a production well to upgrade the heavy oil before transporting to the refinery.

US20100294489 describe methods for heating heavy oil inside a production well. The method raises the subsurface temperature of heavy oil by utilizing an activator that has been injected below the surface. The activator is then excited with a generated microwave frequency such that the excited activator heats the heavy oil. However, the prior application uses higher frequency—0.3 gigahertz (GHz) to 100 GHz, and thus requires more energy to implement than the invention herein.

US20100294488 describes a method for preheating a formation prior to beginning steam assisted gravity drainage production. The method proceeds by forming a steam assisted gravity drainage production well pair within a formation. A preheating stage is then begun by injecting an activator into the formation. The preheating stage is then accomplished by exciting the activator with radio frequencies of 0.3 gigahertz (GHz) to 100 GHz. This is followed by beginning the steam assisted gravity drainage operation. However, the methods described herein also use the much higher frequency range, and thus are more energy intensive.

There thus still exists a need for an enhanced process that couples the use of non-microwave RF radiation to produce an upgraded hydrocarbon within a production well within a bitumen or heavy oil formation.

SUMMARY OF THE INVENTION

A method for heating heavy oil inside a production well is provided, which raises the subsurface temperature of heavy oil by utilizing an activator that has been injected below the surface. The activator is then excited with a generated non-microwave frequency from 0.1 MHz to 300 MHz such that the excited activator heats the heavy oil.

The method also teaches an alternate embodiment for upgrading heavy oil inside a production well. The method raises the subsurface temperature of heavy oil by utilizing an activator that has been injected below the surface. The activator is then excited with a generated non-microwave radio frequency from 0.1 Mhz to 300 Mhz such that the excited activator efficiently absorbs the RF and thus heats the surrounding heavy oil. A catalyst is injected below the surface such that the catalyst contacts the heated heavy oil, thereby producing an upgraded heavy oil. The catalyst can be co-injected with the activator, pre-injected or injected after the initial heating.

One embodiment is a method of obtaining heavy oil from a subsurface reservoir, by injecting an activator into a subsurface reservoir containing heavy oil at a first temperature, wherein said activator is a metal containing asymmetric molecule that absorbs RF radiation, exciting the activator with a generated RF radiation having a frequency between 0.1 MHz to 300 MHz and raising said first temperature of said heavy oil to produce a heated heavy oil; and then pumping said heated heavy oil out of said subsurface reservoir. Preferably, one or more activators is injected into the subsurface reservoir. A plurality of frequencies are generated such that one or more frequencies excites the one or more activators and optionally the other one or more frequencies excites one or more constituents of the heavy oil.

The method can also be combined with one or more suitable catalysts to allow in situ upgrading of said heavy oil, and can be combined with a variety of production well types, including gravity assisted drainage production.

The "activator" is defined herein as any molecule that absorbs RF energies as equal to or more efficiently than hydrocarbons or an aqueous medium.

The following abbreviations are used herein:

| | |
|---|---|
| cP | centipoise |
| bbl | Barrel or oil, 42 US gallons |
| cSOR | cumulative steam-oil ratio |
| CSS | Cyclic steam stimulation |
| CWE | cold water equivalent |
| DSG | direct steam generation |
| ES-SAGD | Enhanced solvent SADG, aka SAP |
| GOR | gas-oil ratio |
| MPa | megapascals |
| SAGD | steam-assisted gravity drainage |
| SOR | steam-to-oil ratio |
| WTI | West Texas Intermediate, a benchmark for oil prices |

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Figure 1:
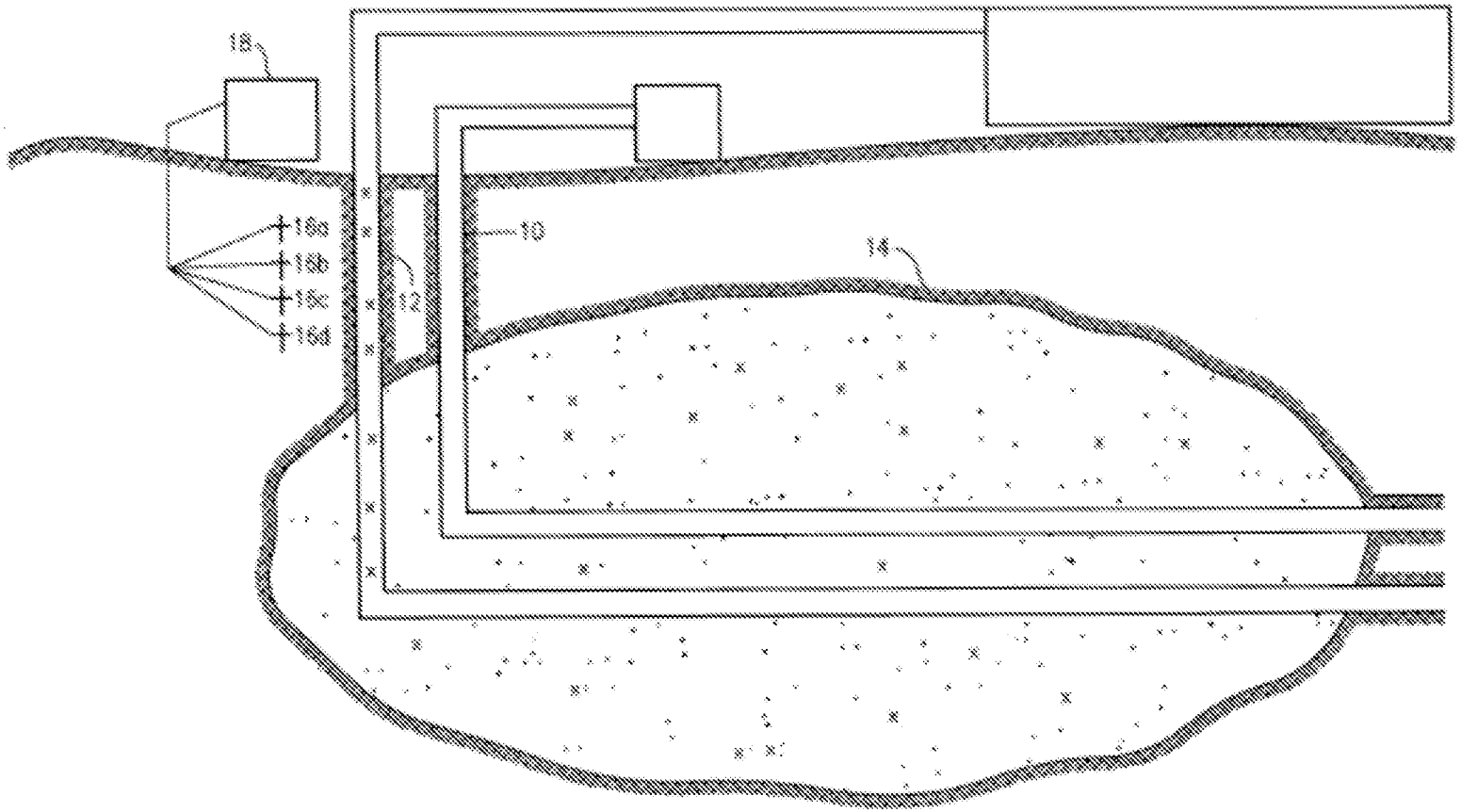
FIG. 1 depicts a method of upgrading heavy oil inside a production well by injecting a catalyst into the production well.

The current method teaches the ability to upgrade heavy oil in a production well. The method first raises the temperature of heavy oil inside a production well of a steam assisted gravity drainage operation. The method also upgrades the heavy oil through the use of a catalyst to hydrogenize or desulfurize the heavy oil, injected into the production well.

During the raising of temperature of the heavy oil inside the production well activators and non-microwave frequencies are utilized. The temperature of the heavy oil is raised inside the production well by injecting an activator into the production well; directing a non-microwave frequency into the production well; exciting the activator with a non-microwave frequency and heating the heavy oil inside the production well with the excited activator.

By choosing specific activators to inject into the production well, one skilled in the art would have the requisite knowledge to select the exact RF frequency required to achieve maximum heating of the activator. Therefore the current method eliminates the need to arbitrarily generate variable non-microwave frequency, which may or may not be able to efficiently absorb the non-microwave radiation. The activator ionic liquids chosen would have specific properties such as containing positively or negatively charged ions in a fused salt that absorbs RF radiation efficiently with the ability to transfer heat rapidly.

Furthermore, optimal frequencies can be determined in advance, thus improving efficiencies.

Examples of activators include ionic liquids, and may include metal ion salts and may be aqueous. Asymmetrical compounds selected for the non-microwave energy absorbing substance provide more efficient coupling with the microwaves than symmetrical compounds. In some embodiments, ions forming the non-microwave energy absorbing substance include divalent or trivalent metal cations.

Other examples of activators suitable for this method include inorganic anions such as halides. In one embodiment the activator could be a metal containing compound such as those from period 3 or period 4. In yet another embodiment the activator could be a halide of Na, Al, Fe, Ni, or Zn, including $AlCl_4^-$, $FeCl_4^-$, $NiCl_3^-$, $ZnCl_3^-$ and combinations thereof. Other suitable compositions for the activator include transitional metal compounds or organometallic complexes. The more efficient an ion is at coupling with the MW/RF radiation, the faster the temperature rise in the system.

In one embodiment the added activator chosen would not be a substance already prevalent in the crude oil or bitumen. Substances that exhibit dipole motion that are already in the formation include water, salt, asphaltenes and other polar molecules. By injecting an activator not naturally present in the system, it not only permits the operator to establish the exact non-microwave frequency required to activate the activator, but also permits the operator the knowledge of how to eliminate the activator afterwards.

Methods of eliminating the activator include chelation, adsorption, crystallization, distillation, evaporation, flocculation, filtration, precipitation, sieving, sedimentation and other known separation methods. All these methods are enhanced when one skilled in the art are able to ascertain the exact chemical that one is attempting to purge from a solution.

One skilled in the art would also be able to select a specific activator that does not need to be eliminated from the solution. One such example of an activator that can remain in crude oil includes activated carbon or graphite particles.

In one embodiment a predetermined amount of activators, comprising of metal ion salts, are injected into the production well via a solution. Non-microwave frequency generators are then operated to generate non-microwave frequencies capable of causing maximum excitation of the activators.

For some embodiments, the non-microwave frequency generator defines a variable frequency source of a preselected bandwidth sweeping around a central frequency. As opposed to a fixed frequency source, the sweeping by the non-microwave frequency generator can provide time-averaged uniform heating of the hydrocarbons with proper adjustment of frequency sweep rate and sweep range to encompass absorption frequencies of constituents, such as water and the non-microwave energy absorbing substance, within the mixture.

The non-microwave frequency generator may produce radio waves that have frequencies ranging from 0.1 MHz to 300 MHz. At these lower frequencies the wavelength is longer than microwave frequencies and can therefore travel farther into the subsurface and the resultant heavy oil bitumen.

Optionally, non-microwave frequency generators can be utilized to excite pre-existing substances in the aqueous formation that contain existing dipole moments. Examples of these pre-existing substances include: water or salt water used in SAGD or ES-SAGD operations, asphaltene, heteroatoms and metals.

In an alternate embodiment multiple activators with differing peak excitation levels can be dispersed into the production well. In such an embodiment one skilled in the art would be capable of selecting the preferred range of radio frequencies to direct into the activators to achieve the desired temperature range.

In one embodiment the activators provide all the heat necessary to upgrade the oil in the production well. In an alternate embodiment it is also possible that the activator supplements preexisting heating methods in the production well, such as the various steam heating methods.

In yet another embodiment the heat generated by the activators will be sufficient to produce upgrading of the heavy oil in-situ in the production well. In this instance the upgrading of the heavy oil will supplement the upgrading provided by the catalyst.

For example, three different activators with three distinct radio frequencies are injected along the vertical length of the production well. With three different activators the amount of rotational mechanism achieved through each would vary, therefore the temperature in the production well would be different dependant upon the specific activator activated. One skilled in the art would be capable of generating a specific ideal temperature range in the production well by selectively operating the radio frequency generators to activate the appropriate activators to obtain desired temperature range.

The activators can be injected into the production well through a variety of methods as commonly known in the art. Examples of typical methods known in the art include injecting the activators via aqueous solution.

The activators are able to heat the heavy oil/bitumen via conductive and convective mechanisms by the heat generation of the activators. The amount of heat generated could break the large molecules in the heavy oil/bitumen into smaller molecules and hence decrease the viscosity permanently.

RF frequencies come from frequency generators that can be situated either above or below ground, but are preferably situated in the reservoir at or near the pay zone. The radio antennas should be directed towards the activators and can be placed either above ground, below ground or a combination of the two. It is the skill of the operator to determine the optimal placement of the radio antenna to target a particular activator to achieve dipole moment vibration while still maintaining ease of placement of the antennas.

In yet another embodiment, the oil to be upgraded inside the production well is obtained from an enhanced steam assisted gravity drainage method. In such a method, since a preexisting activator (e.g., brine) is already present it eliminates the need to inject additional activators. A radio frequency antenna is directed into the production well, the activator is excited with radio frequencies, followed by upgrading the oil inside the production well with the excited activator.

The addition of the catalyst aids in the upgrading of the heavy oil. In one embodiment the catalyst is injected into the production well. In another embodiment the catalyst is injected into the production well and the formation. In yet another embodiment the catalyst is injected only into the formation. In each of these embodiments the placement of the catalyst will induce the upgrading in the vicinity of the injection area and continue upgrading as the catalyst moves along the steam assisted gravity drainage operation. The injection of the catalyst can occur through any known injection method in the art.

The catalyst is used to either hydrogenate or desulfurize the heavy oil. Any known catalyst in the art capable of hydrogenating or desulfurizing the heavy oil to induce upgrading can be utilized.

In one embodiment the catalyst injected into the production well, the formation or both the production well and the formation is typically a liquid catalyst that is either oil soluble or water soluble.

It is preferred that the catalyst is an organometallic complex. The organometallic complex can comprise either one or a combination of a group 6, 7, 8, 9 or 10 metal from the periodic table. More preferably the metal complex comprises nickel, manganese, molybdenum, tungsten, iron or cobalt. In yet another embodiment it is preferred that the catalyst is a peroxide, one example of such a peroxide is hydrogen peroxide.

Other embodiments of hydrogenation catalysts include active metals that specifically have a phosphorus chemical shift value in $^{31}$P-CPMAS-NMR, the peak of which is in the range of preferably 0 to −20 ppm, more preferably −5 to −15 ppm, and even more preferably −9 to −11 ppm. Other embodiments of desulfurization catalysts include those that have hydrogenation functionality.

In a non-limiting embodiment, FIG. 1 depicts a method of utilizing activators in a SAGD system to heat the heavy oil. Normally, the activator can be injected into the production well using any method typically known in the art. In this embodiment the activator is placed downhole either via the steam injection well 10 or the production well 12. In this embodiment the activator is depicted with the symbol "x". Once the activators are in the stratum 14, radio antenna 16*a*, 16*b*, 16*c* and 16*d*, which are attached to a radio frequency generator 18, are used to heat the activators in the production well 12. In other embodiments two or more radio frequencies are generated such that one range excites the activator and the other range excites the existing constituents of the heavy oil.

Figure 2:
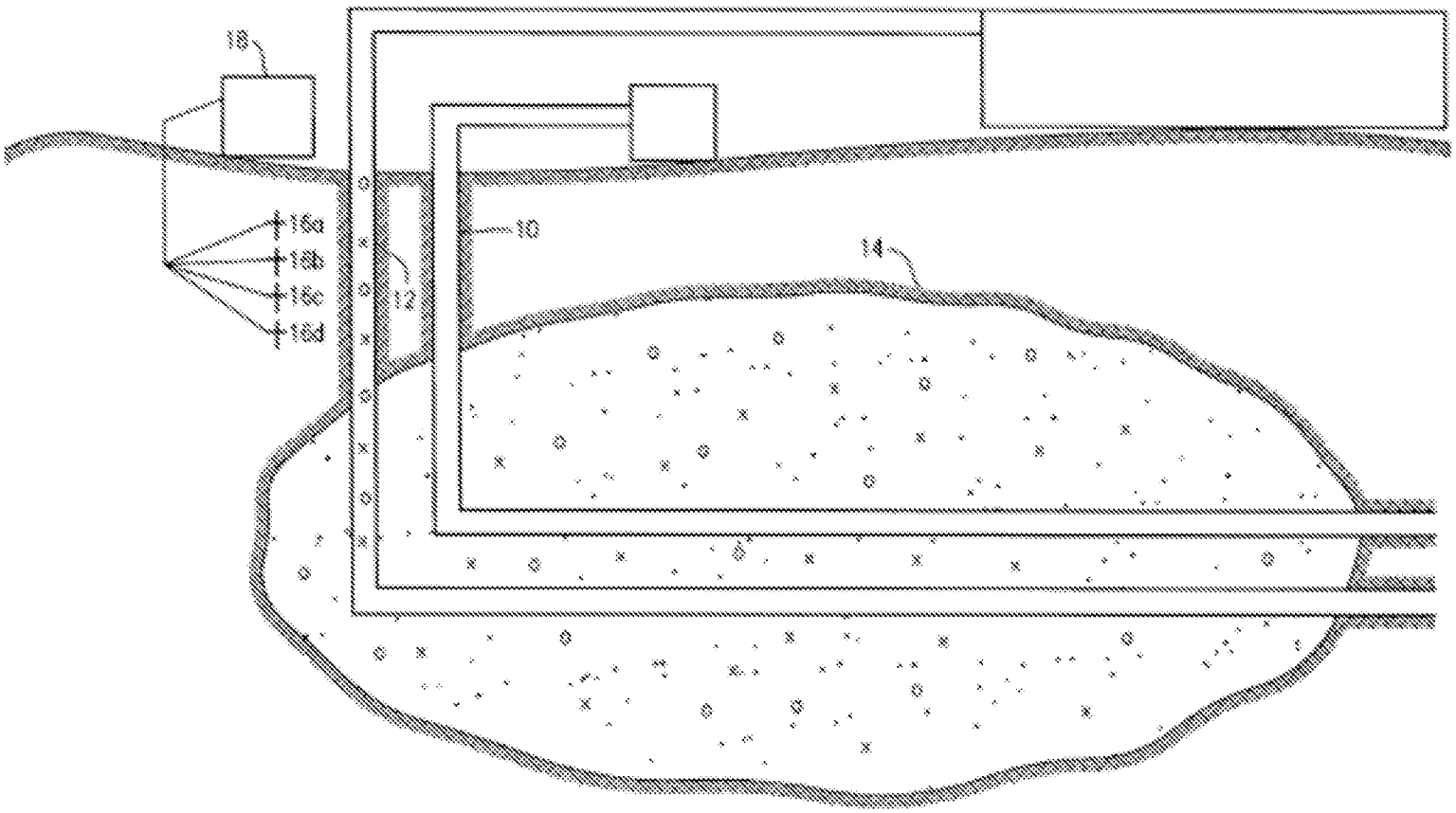
FIG. 2 depicts a method of upgrading heavy oil inside a production well by injecting a catalyst into the formation.

In yet another non-limiting embodiment, FIG. 2 depicts a method of utilizing a method of heating activators in a SAGD system while upgrading the heavy oil with a catalyst. The catalyst can be injected into the formation using any method typically known in the art. In this embodiment the catalyst is depicted with the symbol "o". In this embodiment the activator is placed downhole either via the steam injection well 10 or the production well 12. In this embodiment the activator is depicted with the symbol "x". Once the activators are in the stratum 14, radio antenna 16*a*, 16*b*, 16*c* and 16*d*, which are attached to a radio frequency generator 18, are used to heat the activators in the production well 12.

Figure 3:
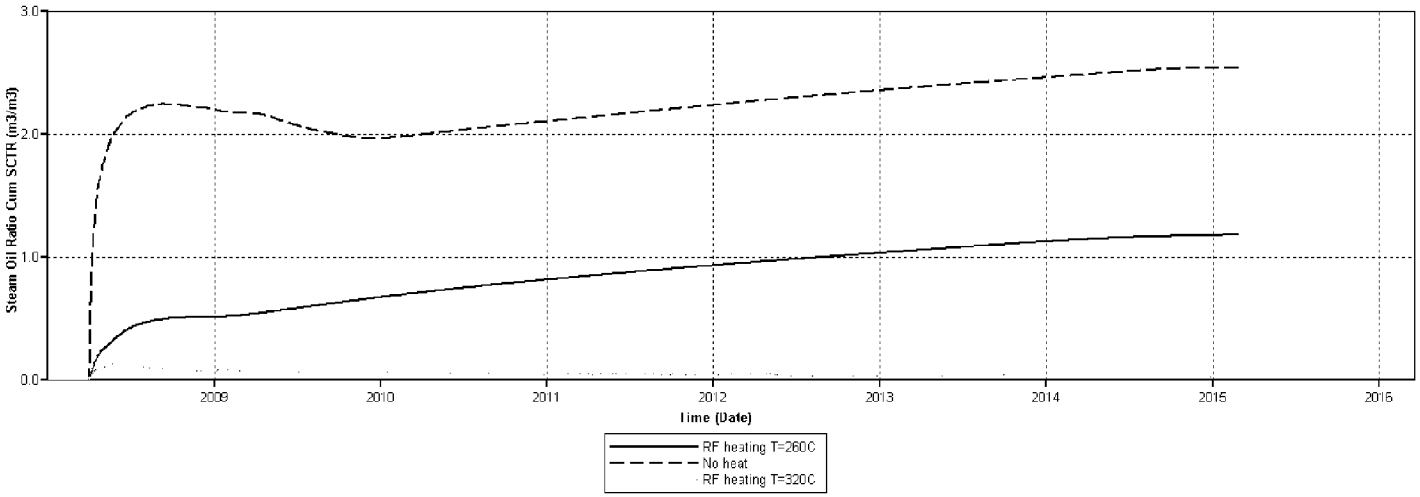
FIG. 3A-B depicts the results of CMG STARS simulations prepared by using RF to supplement the SAGD process. Shown in 3A (top plot) is Steam Oil Ratio Cumulative plotted against time in years. Shown in 3B (bottom panel) is Cumulative Oil versus time in years. Neither of these plots includes activator.
Figure 3:
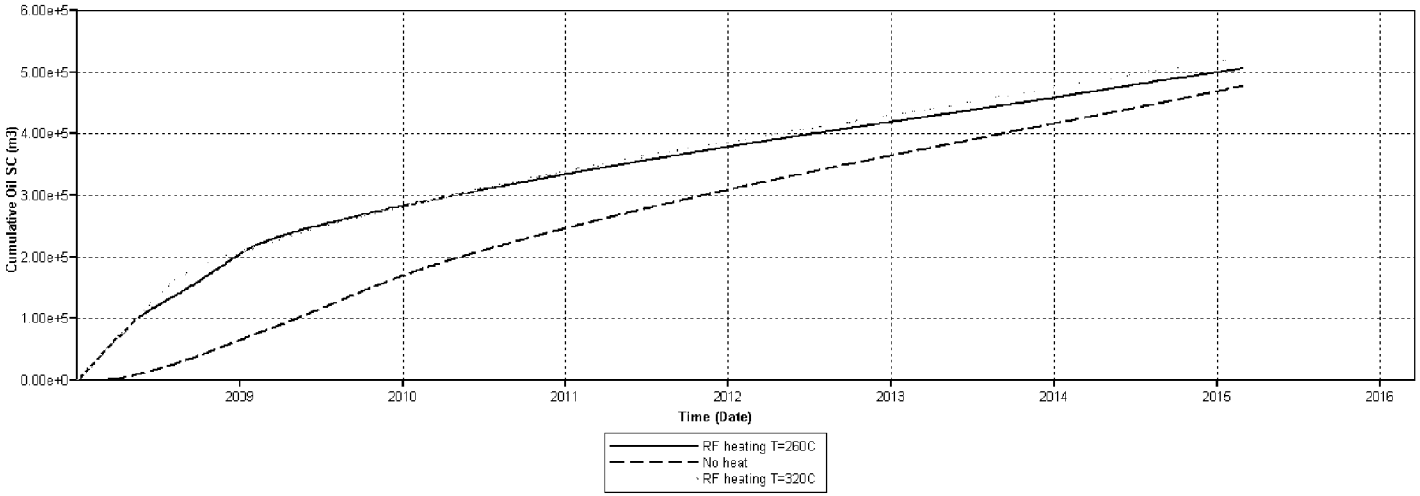

FIG. 3A-B depicts the results of CMG STARS simulations. The plot is A-Cum SOR vs time generated using CMG STARS simulations on Athabasca type reservoir without use of an activator. These figures show that operators can significantly reduce the CSOR by incorporating RF heating into the SAGD wells with better production. Economics will dictate the right balance between steam and RF with activators to maximize profitability for a given project.

The plot in 3A shows that RF heating of injected activators can significantly increase oil production and reduce the Steam Oil Ratio ("SOR") compared to standard SAGD process. The SOR is a metric used to quantify the efficiency of oil recovery processes based on types of steam injection. The steam-oil ratio measures the volume of steam used to produce one unit volume of oil. The lower the ratio, the higher the efficiency of the steam use. As technology improves, less steam is required to produce an equivalent barrel of oil.

The plot in 3B shows oil production is increased by using RF to supplement the SAGD process. In other words, the operator can capture additional resources with the new process.

Another advantage of activator RF heating compared to regular water RF heating is the achieved final temperature. Water heating can be done up to vaporization temperature (~260° C. under reservoir conditions). However, activator heating can reach higher temperatures. The plot compares 260° C. and 320° C. heating. Both provide similar oil production rates but 320° C. heating has much lower SOR. The higher temperatures will also facilitate catalytic in situ upgrading.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The following art is cited herein for the convenience of the reader, and each is incorporated by reference in its entirety.

U.S. Pat. No. 4,144,935
U.S. Pat. No. 5,055,180
US20100294489
US20100294488

We claim:

1. A method of obtaining heavy oil from a subsurface reservoir, comprising:

a) injecting at least three different activators into a producing stratum of a steam assisted gravity drainage (SAGD) system in a subsurface reservoir containing heavy oil at a first temperature, wherein said at least three different activators are metal-containing asymmetric molecules that absorb different RF radiation and have different peak excitation levels;

b) exciting the activators with a generated RF radiation having a frequency between 0.1 MHz to 300 MHz to generate at least three excited activators and raising said temperature of said heavy oil to above 260° C. with said excited activators to produce a heated heavy oil; and c) pumping said heated heavy oil out of said subsurface reservoir, wherein said at least three excited activators increase the oil production more than a SAGD process without said at least three excited activators, and wherein said at least three excited activators decrease the Steam Oil Ratio (SOR) by 50% to 80% compared to a SAGD process without said at least three excited activators.

2. The method of claim 1, wherein a plurality of frequencies are generated such that three or more frequencies excites the activators and another one or more frequencies excites one or more constituents of the heavy oil.

3. The method of claim 1, wherein at least one of the activators is a halide compound.

4. The method of claim 3, wherein the halide compound comprises a metal from period 3 or period 4 of the periodic table.

5. The method of claim 1, wherein at least one of the activators is selected from the group consisting of $AlCl_4^-$, $FeCl_4^-$, $NiCl_3^-$, $ZnCl_3^-$ and combinations thereof.

6. The method of claim 1, wherein the at least 3 different activators are injected into the formation simultaneously via an injection well and a production well.

7. The method of claim 1, wherein the at least 3 different activators are injected into the formation via an injection well or a production well.

8. The method of claim 1, further comprising injecting a catalyst into said subsurface reservoir so as to contact said heavy oil, and exciting at least one of the activators with said RF radiation to raise said temperature of said heavy oil to allow in situ upgrading of said heavy oil.

9. The method of claim 8, wherein at least one of the activators is selected from the group consisting of $AlCl_4^-$, $FeCl_4^-$, $NiCl_3^-$, $ZnCl_3^-$ and combinations thereof.

10. The method of claim 8, wherein said catalyst is a hydrogenation catalyst, a desulfurization catalyst or a combination thereof.

11. The method of claim 8, wherein the upgrading of the heavy oil causes some of the molecules of the hydrocarbons to be converted into smaller molecules.

12. The method of claim 8, wherein the catalyst is a liquid catalyst or a slurry.

13. The method of claim 8, wherein the catalyst is an organometallic complex.

14. The method of claim 13, wherein the organometallic complex comprises a group 6, 7, 8, 9 or 10 metal from the periodic table.

15. The method of claim 8, wherein the catalyst is injected into the production well.

16. The method of claim 8, wherein the catalyst is injected into the formation.

* * * * *